US006375032B1

(12) United States Patent
Kim

(10) Patent No.: US 6,375,032 B1
(45) Date of Patent: Apr. 23, 2002

(54) DEVICE FOR TAKING OUT A STRAW FOR A BEVERAGE CAN

(76) Inventor: Il Hee Kim, #513 203 Jukong Apt. 961, Sunbu dong, Ansan-shi (KR), 425 140

( * ) Notice: Subject to any disclaimer, the term of this patent is extended or adjusted under 35 U.S.C. 154(b) by 0 days.

(21) Appl. No.: 09/445,437

(22) PCT Filed: Jun. 11, 1998

(86) PCT No.: PCT/KR98/00154

§ 371 Date: Mar. 14, 2000

§ 102(e) Date: Mar. 14, 2000

(87) PCT Pub. No.: WO98/56669

PCT Pub. Date: Dec. 17, 1998

(30) Foreign Application Priority Data

Jun. 12, 1997 (KR) ..... 97 14066
May 23, 1998 (KR) ..... 98 18686

(51) Int. Cl.[7] ..... A47G 19/22
(52) U.S. Cl. ..... 220/707; 220/906
(58) Field of Search ..... 220/906, 269, 220/270, 703, 705, 707, 709, 710, 837, 839

(56) References Cited

U.S. PATENT DOCUMENTS 3,410,391 A * 11/1968 Kanter ..... 220/839 X
4,537,324 A * 8/1985 Wang
4,690,294 A * 9/1987 Jones
4,826,034 A * 5/1989 Forbes
5,054,639 A * 10/1991 Ahn
5,899,351 A * 5/1999 Murphy et al. ..... 220/703 X

* cited by examiner

*Primary Examiner*—Nathan J. Newhouse
(74) *Attorney, Agent, or Firm*—Jacobson Holman, PLLC

(57) ABSTRACT

By lifting the other end of a grip, one end of the grip presses down a can lid portion, and a can opening is formed in a can upper wall while a score line delimiting the can lid portion is torn. The can lid portion is moved into the beverage can, an edge of the can lid portion, which is opposed to the other end of the grip is moved and contacted to a connection piece thereby to bend the connection piece along its score line. Accordingly, the continuously moving can lid portion pulls the connection piece toward the center of the beverage can, and a rotating member integrally connected to the connection piece is rotated about the line connecting the centers of a pair of projections. As the rotating member is rotated, an upper end of the rotating member is moved toward the can opening, and a bellows part of a straw, which is prevented from upward expanding, projects through the can opening and beyond the can upper wall. Therefore, it is possible to drink beverage through the projected straw.

7 Claims, 7 Drawing Sheets

DEVICE FOR TAKING OUT A STRAW FOR A BEVERAGE CAN

TECHNICAL FIELD

The present invention relates to a device for taking out a straw for a beverage can, and more particularly to a device for taking a straw for a beverage can, by which a straw compressively received in a beverage can may be automatically projected through a can opening and beyond a can upper wall while a can lid portion formed when a beverage can is opened is moved downward or upward into or out of the beverage can, whereby it is possible to conveniently and hygienically drink beverage.

BACKGROUND ART

Referring to FIG. 1, there is illustrated a partially broken perspective view which shows a structure of a beverage can of the prior art. A beverage can 10 is generally made from aluminum. The beverage can 10 includes a can side wall 11 having substantially a cylindrical configuration, and a can upper wall 12 and a can bottom wall which close an upper end and a lower end of the cylindrical side wall 11, respectively. The can upper wall 12 is provided with a grip 15 which is secured to the can upper wall 12 by using an appropriate technique well known in the art, such as rivetting. Below one end of the grip 15, the can upper wall 12 is formed with a score line which delimits a can lid portion 14. By lifting the other end of the grip 15, the one end of the grip 15 presses down the can lid portion 14 encompassed by the score line, then the score line is torn, and the can lid portion 14 is moved into the beverage can 10 to define a can opening 13 in the can upper wall 12, whereby it is possible to drink beverage through the can opening 13.

However, in the beverage can of the prior art, constructed as mentioned above, since one's lip must be put onto the can upper wall defining the can opening, hygiene cannot be ensured. In other words, since foreign material such as dust, etc. is adhered onto the can upper wall, it is necessary to remove the foreign material such as dust, etc. before opening the beverage can. However, although it is possible to locate a tissue, etc. when drinking the beverage can in office or home, it is difficult to locate the tissue, etc. when drinking the beverage can in the fields. Accordingly, in the latter case, since the foreign material such as dust, etc. is eliminated using handkerchief or clothes, etc., hygiene cannot be ensured. Also, since one's lip must be put onto the can upper wall defining the can opening to drink beverage, beverage is apt to run down out of the beverage can even with minor inadvertence, thereby to soil clothes.

In order to hygienically drink beverage, it is usual practice to drink beverage through a portion of a straw which is projected upward beyond the can upper wall in a state that the straw is inserted through the can opening into the beverage can. However, in this case, it is inconvenient to prepare a separate straw. Also, when the straw is used, since it is needed to grasp the beverage can with one hand and the straw with the other hand, the use thereof is very troublesome.

DISCLOSURE OF INVENTION

Accordingly, the present invention has been made in an effort to solve the problems occurring in the prior art, and an object of the present invention is to provide a device for taking out a straw for a beverage can, by which a straw compressively received in a beverage can may be automatically projected through a can opening and beyond a can upper wall while a can lid portion formed when a beverage can is opened is moved downward or upward into or out of the beverage can, whereby it is possible to conveniently and hygienically drink beverage.

According to one aspect of the present invention, there is provided a device for taking out a straw for a beverage can, comprising: A rotating member rotatably secured to a can upper wall or a can side wall in the beverage can and defining an inner space into which the straw can be inserted, the rotating member being rotated by a can lid portion formed when the beverage can is opened, to project the straw upward through a can opening and beyond the can upper wall.

According to another aspect of the present invention, the device further comprises: a fixed member having an upper end secured to the can upper wall in the beverage can and a lower end to which the rotating member is rotatably secured.

According to another aspect of the present invention, the rotating member has a cylindrical configuration, a portion of the rotating member is cut in a longitudinal direction and bent to define a connection piece which extends slantingly toward the can upper wall, and an upper end of the connecting piece is secured to the can upper wall.

According to another aspect of the present invention, substantially a middle portion of the connection piece is formed with a score line, an edge of the can lid portion moving into the beverage can when the beverage can is opened is contacted to the middle portion to bend the connection piece along the score line, and the rotating member is rotated while the can lid portion is continuously moved into the beverage can after bending the connection piece.

According to another aspect of the present invention, the straw has a bellows part and a straight part, the bellows part being compressively received in the inner space of the rotating member and the straight part extending from a lower end of the rotating member toward a can bottom wall.

According to another aspect of the present invention, the straw comprises a vinyl tube and a coil spring wound around a circumferential inner or outer surface of the vinyl tube.

According to another aspect of the present invention, the fixed member has a semicircular cross-section, the rotating member is fitted into the fixed member, and the upper end of the fixed member is formed with a barrier piece for blocking upward expansion of the straw.

Also, according to still another aspect of the present invention, there is provided a device for taking out a straw for a beverage can, comprising: a plate-shaped straw take-out member having one end defining an inner space into which the straw can be inserted and formed with an engaging piece, the other end formed with a stepped portion into which the engaging piece can be engaged, and a middle portion bent such that a degree is defined between the ends.

According to yet still another aspect of the present invention, the straw take-out member comprises a pair of elastic plates integrally connected with each other, the pair of elastic plates being contacted with each other and positioned into a side by side relationship when the engaging piece is engaged into the stepped portion, and a can lid portion being formed when the beverage can is opened disengages the engaging piece from the stepped portion while it is moved into the beverage can.

By the features of the present invention, due to the fact that a straw compressively received in a beverage can may be automatically projected through a can opening and beyond a can upper wall while a can lid portion formed when a beverage can is opened is moved downward or upward into or out of the beverage can, it is not needed to prepare a separate straw and to grasp the straw with a hand while drinking beverage using the straw, whereby convenience is ensured. Also, since a disinfected straw is contained in the beverage can such that it is projected outside to be conveniently used, it is not needed to put one's lip onto a can upper wall defining a can opening, whereby hygiene is ensured.

BRIEF DESCRIPTION OF DRAWINGS

The above objects, and other features and advantages of the present invention will become more apparent after a reading of the following detailed description taken in conjunction with the drawings, in which.

BEST MODE FOR CARRYING OUT THE INVENTION

Figure 1:
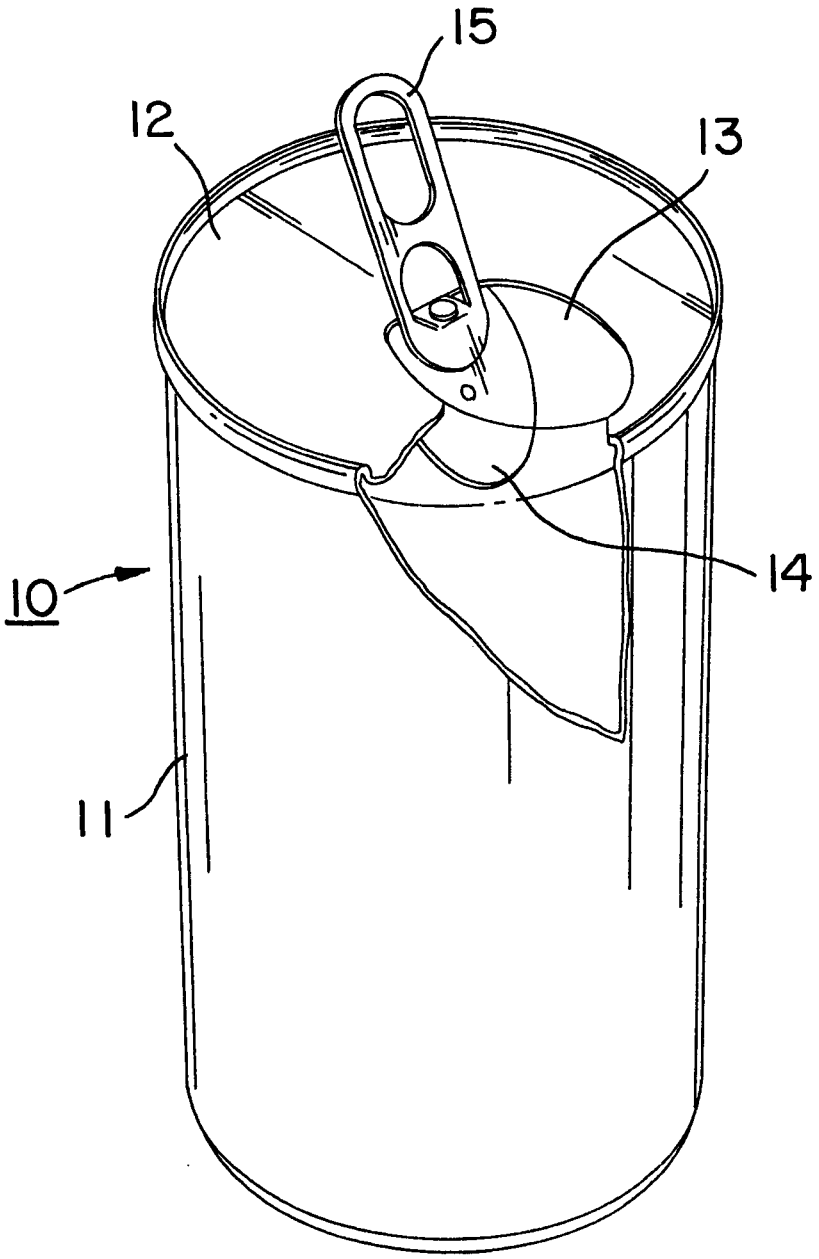
FIG. 1 (PRIOR ART)
FIG. 1 is a partially broken perspective view illustrating a structure of a beverage can of the prior art.
Figure 2:
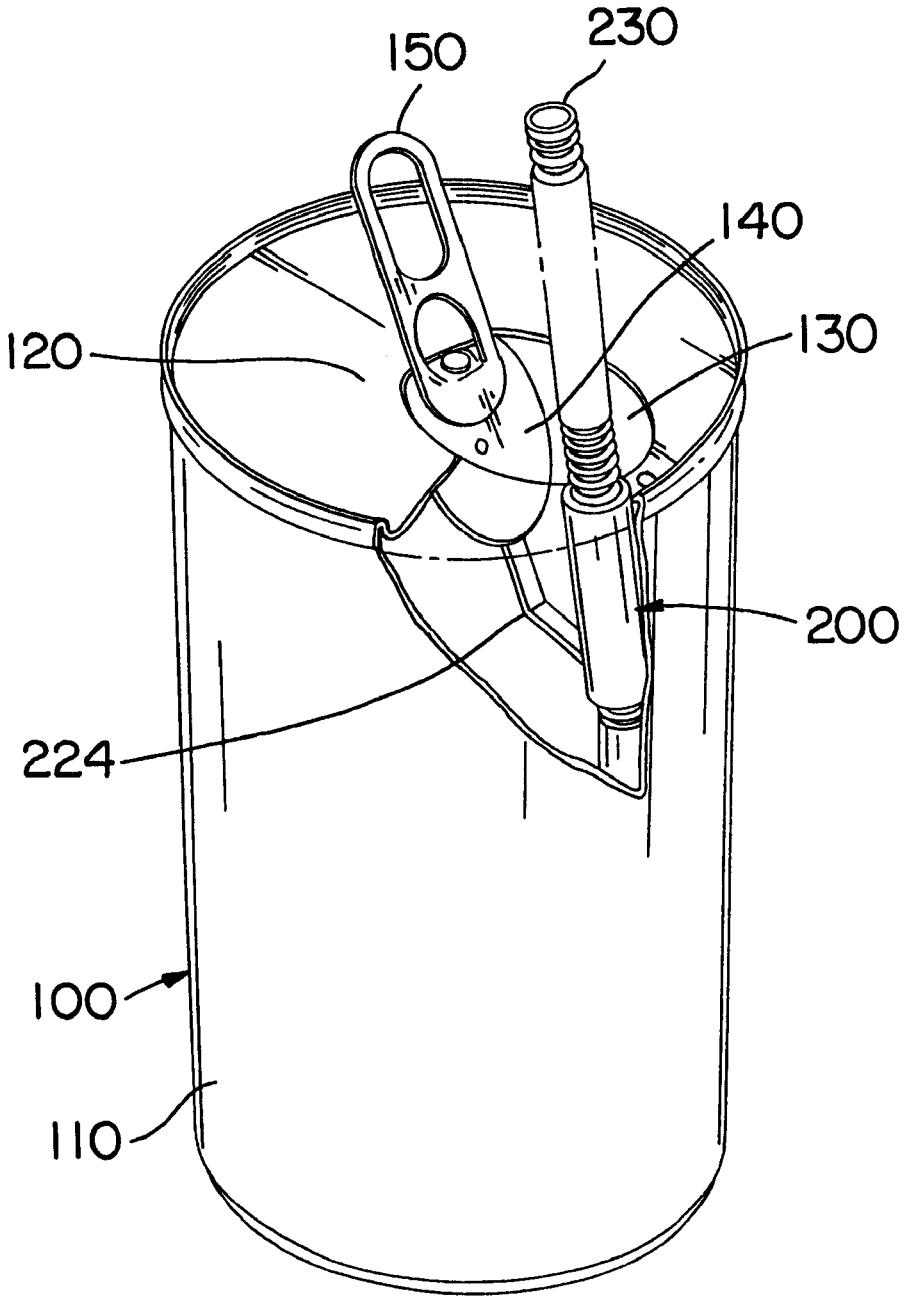
FIG. 2 is a partially broken perspective view illustrating a state in which a beverage can having installed therein a device for taking out a straw in accordance with an embodiment of the present invention is opened.

Reference will now be made in greater detail to a preferred embodiment of the invention, an example of which is illustrated in the accompanying drawings. Wherever possible, the same reference numerals will be used throughout the drawings to refer to the same or like parts.

Referring to FIGS. 2 through 6, a beverage can 100 is generally made from aluminum. The beverage can 100 includes a can side wall 110 having substantially a cylindrical configuration, and a can upper wall 120 and a can bottom wall which close an upper end and a lower end of the cylindrical side wall 110, respectively. The can upper wall 120 is provided with a grip 159 which is secured to the can upper wall 120 by using an appropriate technique well known in the art, such as rivetting. Below one end of the grip 150, the can upper wall 120 is formed with a score line which delimits a can lid portion 140. By lifting the other end of the grip 150, the one end of the grip 150 presses down the can lid portion 140 encompassed by the score line, then the score line is torn, and the can lid portion 140 is moved into the beverage can 100 to define a can opening 130 in the can upper wall 120, whereby it is possible to drink beverage through the can opening 130.

A device 200 for taking out a straw is provided in the beverage can 100 and includes a fixed member 210 and a rotating member 220.

Figure 3:
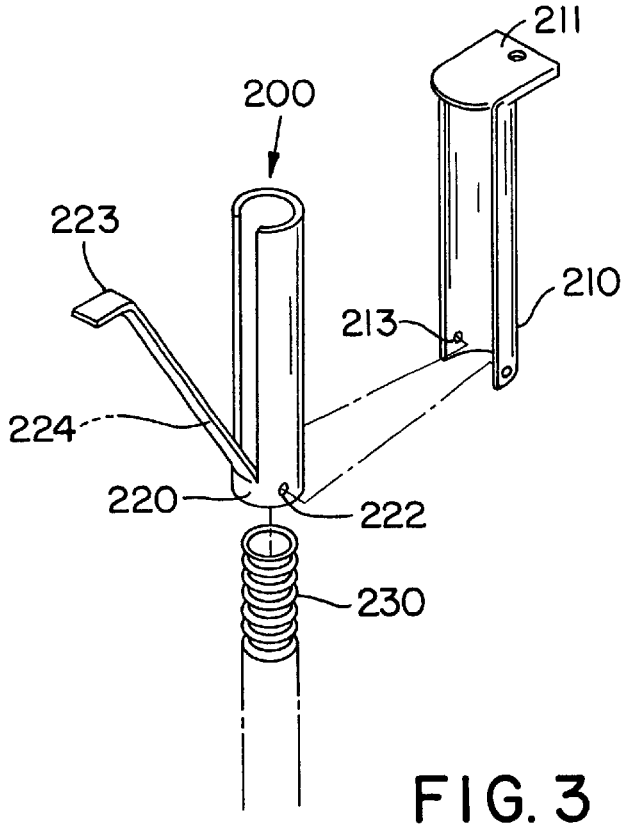
FIG. 3 is an exploded perspective view of the device for taking out a straw according to the present invention.

The fixed member 210, as best shown in FIG. 3, extends in the longitudinal direction and has a semicircular cross-section. An upper end of the fixed member 210 is integrally formed with a barrier piece 211 such that it blocks the semicircular cross-section of the fixed member 210. An inner surface of a lower end of the fixed member 210 is formed with a pair of projections 213 such that they are opposed to each other. The barrier piece 211 is secured to a lower surface of the can upper wall 120 by using an appropriate fastening means, by which the fixed member 210 is firmly secured to the can upper wall 120.

The rotating member 220, as best shown in FIG. 3, has substantially a cylindrical configuration, and a portion of the rotating member 220 is cut in the longitudinal direction and bent in its lower end to define a connection piece 223. The connection piece 223 extends slantingly toward the can upper wall 120, and an upper end of the connection piece 223 is bent again to define a flat portion. The flat portion is secured to a lower surface of the can lid portion 140 by using an appropriate fastening means known in the art. Substantially a middle portion of the connection piece 223 is formed with a score line 224, and thereby the connection piece 223 can be easily bent along the score line 224.

The rotating member 220 is received in a semicircular recess of the fixed member 210, and an outer surface of a lower end of the rotating member 220 is formed with a pair of inserting grooves 222 such that they are opposed to each other. By the fact that the pair of projections 213 formed in the fixed member 210 is inserted into the pair of inserting grooves 222, respectively, the rotating member 220 can be rotated about a line connecting the centers of the pair of projections 213. The rotating member 220 functions to support a straw 230, and in a preferred embodiment of the present invention, the straw 230 has a bellows part and a straight part. The bellows part of the straw 230 is compressively received in the cylindrical rotating member 220, and the straight part of the straw 230 extends downward from the lower end of the rotating member 220 toward the can bottom wall. For this, the lower end of the cylindrical rotating member 220 may be formed with an inward flange and the straight part may have a diameter less than the bellows part. Due to the fact that an upper end of the bellows part contacts to a lower surface of the barrier piece 211 of the fixed member 210, an upward expansion of the bellows part compressively received in the rotating member 220 is prevented.

Figure 4:
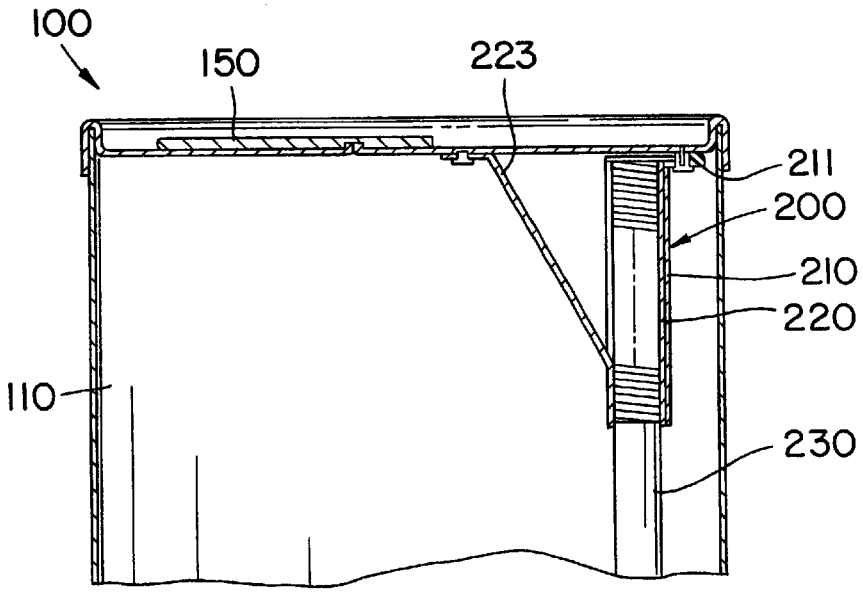
FIG. 4 is a partial cross-sectional view illustrating a state in which the device for taking out a straw of FIG. 3 is installed into the beverage can.

Hereinafter, an operation of the device 200 for taking out a straw in accordance with this embodiment of the present invention will be described in detail:

As shown in FIG. 4, in case that the can lid portion 140 of the beverage can 100 is not opened, the fixed member 210 is firmly secured to the lower surface of the can upper wall 120, and the rotating member 220 is received in the semicircular recess of the fixed member 210. The lower end of the rotating member 220 is rotatably secured to the fixed member 210, and the connection piece 223 of the rotating member 220 is secured at its upper end to the lower surface of the can lid portion 140 while extending slantingly toward the can upper wall 120. The bellows part of the straw 230 is compressively received in the rotating member 220, and the upper end of the bellows part is squeezed against the lower surface of the barrier piece 211 of the fixed member 210.

Figure 5:
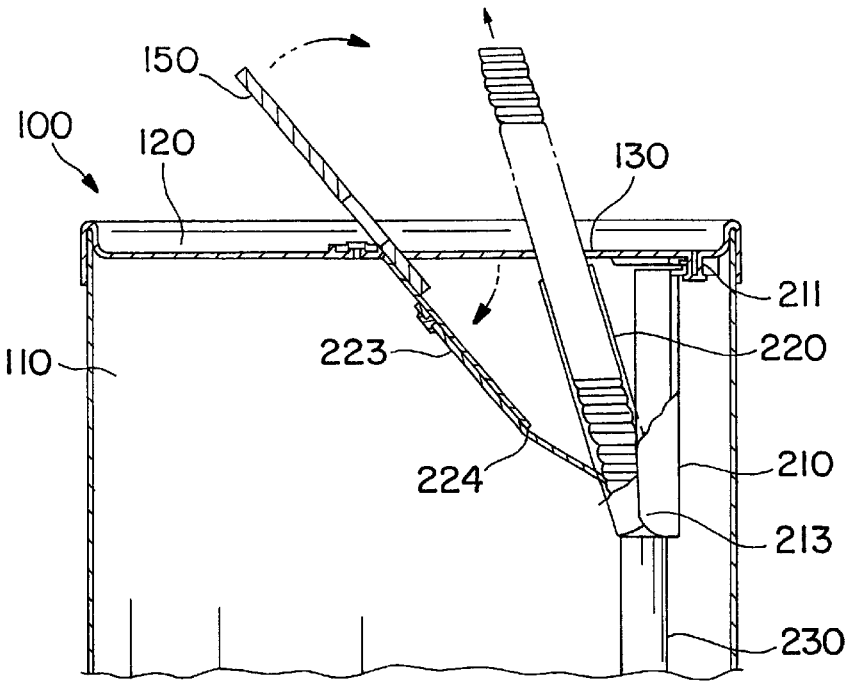
FIG. 5 is a partial cross-sectional view illustrating a state in which the beverage can is opened to project a straw upward beyond a can upper wall.

As shown in FIG. 5, in case that the can lid portion 140 of the beverage can 100 is opened, by lifting the other end of the grip 150, the one end of the grip 150 presses down the can lid portion 140, and according to this, the can opening 130 is formed in the can upper wall 120 while the score line delimiting the can lid portion 140 is torn. The can lid portion 140 is moved into the beverage can 100, an edge of the can lid portion 140, which is opposed to the other end of the grip 150 is moved and contacted to the connection piece 223 thereby to bend the connection piece 223 along the score line 224. Accordingly, the continuously moving can lid portion 140 pulls the connection piece 223 toward the center of the beverage can 100, and the rotating member 220 integrally connected to the connection member 223 is rotated about the line connecting the centers of the pair of projections 213. As the rotating member 220 is rotated, the upper end of the rotating member 220 is moved toward the can opening 130, and the bellows part of the straw 230, which is prevented from upward expanding, projects through the can opening 130 and beyond the can upper wall 120. Therefore, it is possible to drink beverage through the projected straw 230.

Figure 6:
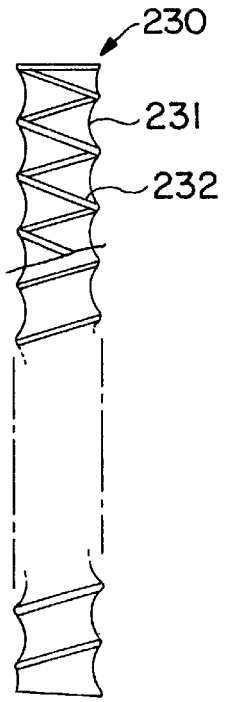
FIG. 6 is a partially broken front view showing another straw in accordance with another embodiment of the present invention.

Referring to FIG. 6, there is illustrated a partially broken front view showing another straw in accordance with another embodiment of the present invention.

The straw 230 according to this embodiment of the present invention includes a vinyl tube 231 and a coil spring 232 wound around a circumferential inner or outer surface of the vinyl tube 231. Accordingly, without forming a separate bellows part in a straw, the entire straw 230 can have a contracting property.

Figure 7:
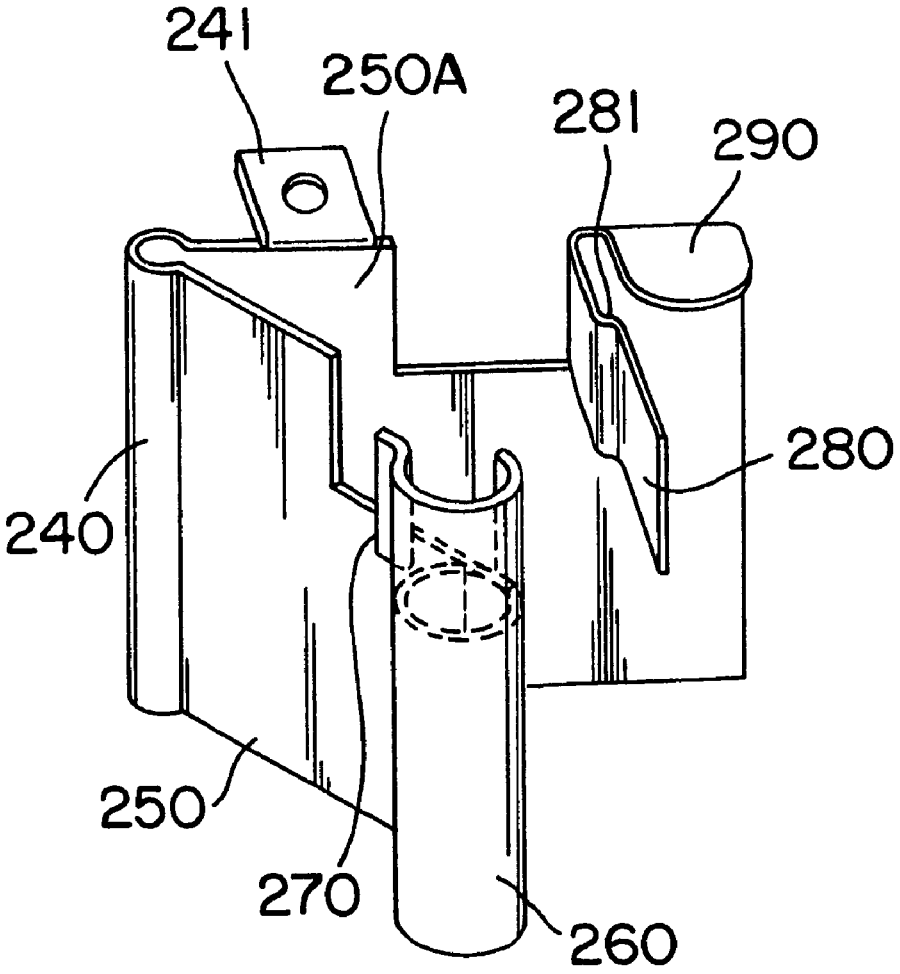
FIG. 7 is a perspective view illustrating an independent appearance of a device for taking out a straw in accordance with still another embodiment of the present invention.
Figure 8:
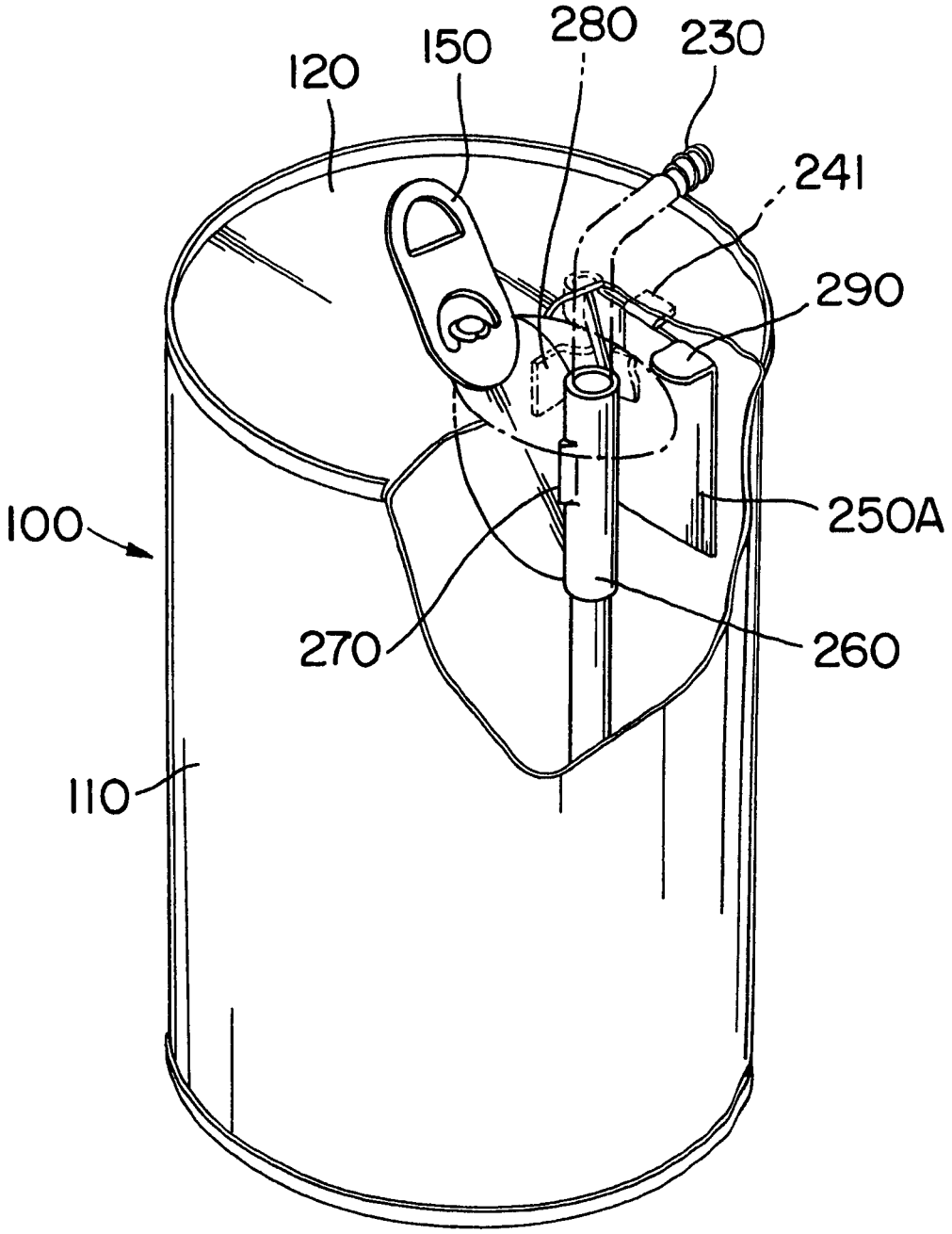
FIG. 8 is a partially broken perspective view illustrating a state in which a beverage can having installed therein the device for taking out a straw of FIG. 7 is opened.
Figure 9:
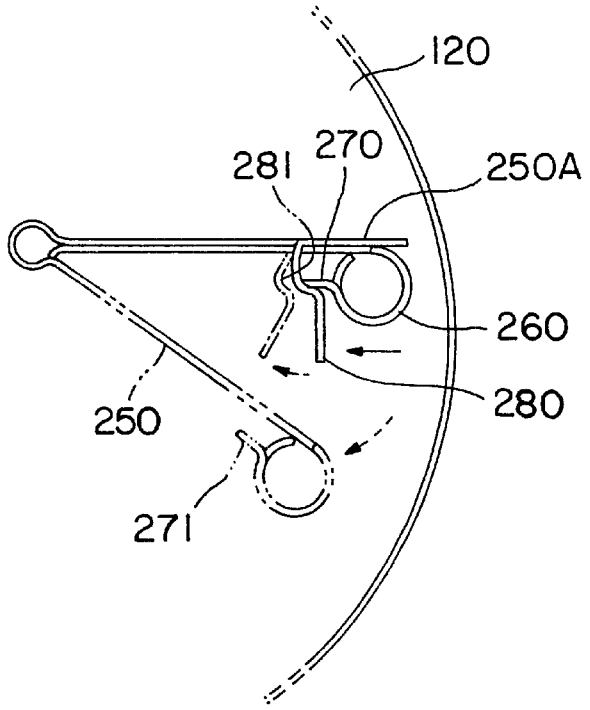
FIG. 9 is a partial sectional plan view for explaining a structure by which the straw is taken out by the device of FIG. 7.

Referring to FIGS. 7 through 9, there is illustrated a device for taking out a straw in accordance with still another embodiment of the present invention. The device for taking out a straw according to this embodiment of the present invention has substantially a hinge-shaped configuration, and has a rotating plate part 250 and a fixed plate part 250*a* which are integrally formed. An elastic channel part 240 is formed in the region where the rotating plate part 250 and the fixed plate part 250*a* are connected to each other, to facilitate the rotation of the rotating plate part 250.

Adjacent to the elastic channel part 240, a connection piece 241 is formed on an upper end surface of the fixed plate part 250*a* such that it extends in a horizontal direction. The connection piece 241 is secured to the can upper wall 120 by using an appropriate fastening means known in the art. A portion of the fixed plate part 250*a* adjacent to the connection piece 241 is cut to define an elastic piece 280 which is bent in a direction perpendicular to a plane of the fixed plate part 250*a*. Substantially a middle portion of the elastic piece 280 is bent to form a stepped portion 281. Between the elastic piece 280 and the free end of the fixed plate part 250*a*, a barrier piece 290 is formed on the upper end surface of the fixed plate part 250*a*. The barrier piece 290 horizontally extends in a direction opposed to the direction in which the connection piece 241 extends.

The free end of the rotating plate part 250 is formed with a straw support tube 260 which has substantially a cylindrical configuration and extends in the longitudinal direction. A portion adjacent to an upper end of the straw support tube 260 is cut and bent in a radial direction to form an engaging piece 270. The straw support tube 260 functions to support the straw 230, and in a preferred embodiment of the present invention, the straw 230 has a bellows part and a straight part. The bellows part of the straw 230 is compressively received in the straw support tube 260, and the straight part of the straw 230 extends downward from a lower end of the straw support tube 260 toward the can bottom wall. For this, the lower end of the straw support tube 260 may be formed with an inward flange and the straight part may have a diameter less than the bellows part. Due to the fact that an upper end of the bellows part contacts to a lower surface of the barrier piece 290 of the fixed plate part 250*a*, upward expansion of the bellows part compressively received in the straw support tube 290 is prevented.

Hereinafter, the operation of the device for taking out a straw according to this embodiment of the present invention, constructed as mentioned above, will be described in detail:

By the fact that the connection piece 241 is secured to the lower surface of the can upper wall 120, the fixed plate part 250*a* is firmly secured to the can upper wall 120. In case that the can lid portion 140 of the beverage can 100 is not opened, the engaging piece 270 of the rotating plate 250 is engaged into the stepped portion 281 of the fixed plate part 250*a*, whereby the rotating plate part 250 is position in a side by side relationship with the fixed plate part 250*a*. In case that the can lid portion 140 of the beverage can 100 is opened, by lifting the other end of the grip 150, the one end of the grip 150 presses down the can lid portion 140, and according to this, the can opening 130 is formed in the can upper wall 120 while the score line delimiting the can lid portion 140 is torn. The can lid portion 140 is moved into the beverage can 100, an edge of the can lid portion 140, which is opposed to the other end of the grip 150 is moved and contacted to the elastic piece 280 thereby to disengage the engaging piece 270 from the stepped portion 281. If the the engaging piece 270 is disengaged from the stepped portion 281, the rotating plate part 250 positioned in the side by side relationship with the fixed plate part 250*a* is rotated such that a degree is defined between the two plate parts 250 and 250*a*. As the rotating plate part 250 is rotated, the straw support tube 260 formed in the free end of the rotating plate part 250 is moved toward the can opening 130, and the bellows part of the straw 230, which is prevented from upward expanding, projects through the opening 130 and beyond the can upper wall 120. Therefore, it is possible to drink beverage through the projected straw 230.

Figure 10:
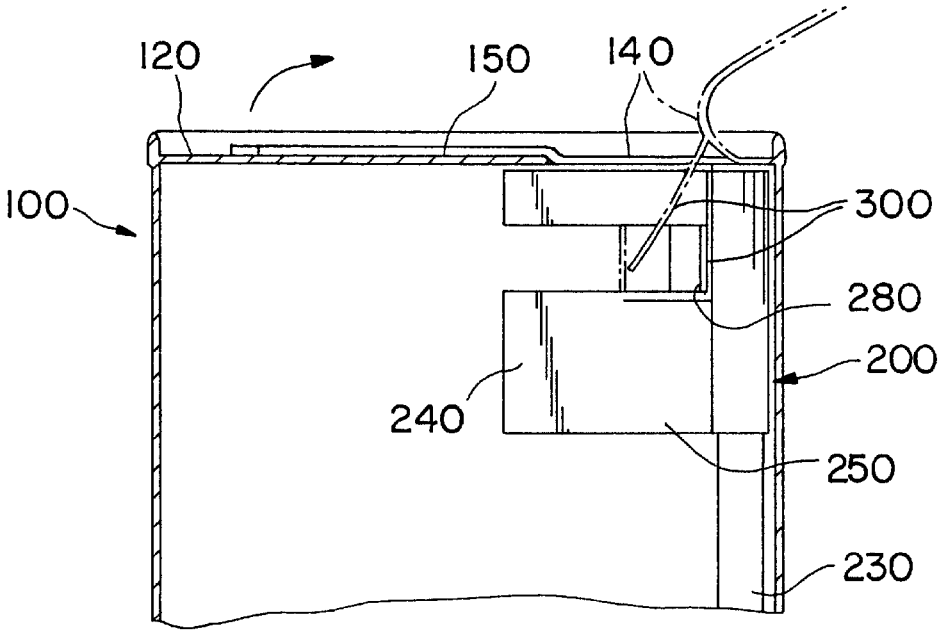
FIG. 10 is a partial cross-sectional view for explaining a structure by which the straw is taken out in accordance with yet still another embodiment of the present invention.

Referring to FIG. 10, there is illustrated a partial cross-sectional view for explaining a structure by which the straw is taken out in accordance with yet still another embodiment of the present invention.

In this embodiment of the present invention, a can opening is formed in the can upper wall 120 while a can lid portion 140 formed in the can upper wall 120 of the beverage can 100 is lifted. The device according to this embodiment is the same with that according to the embodiment shown in FIGS. 7 through 9, except that a projecting flange portion 300 is integrally formed in the lower surface of the can lid portion 140. The projecting flange portion 300 disengages the engaging piece 270 from the stepped portion 281 while moving as the can lid portion 140 is lifted.

Industrial Applicability

As a result, according to the present invention, due to the fact that a straw compressively received in a beverage can may be automatically projected through a can opening and beyond a can upper wall while a can lid portion formed when a beverage can is opened is moved downward or upward into or out of the beverage can, it is not needed to prepare a separate straw and to grasp the straw with a hand while drinking beverage using the straw, whereby convenience is ensured. Also, since a disinfected straw is contained in the beverage can such that it is projected outside to be conveniently used, it is not needed to put one's lip onto a can upper wall defining a can opening, whereby hygiene is ensured.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A device for taking out a straw for a beverage can comprising:

a rotating member rotatably secured to a can upper wall or a can side wall in the beverage can and defining an inner space into which the straw can be inserted, said rotating member being rotated by a can lid portion formed when said beverage can is opened, to project said straw upward through a can opening and beyond said can upper wall, and a fixed member having an upper end secured to said can upper wall in said beverage can and a lower end to which said rotating member is rotatably secured.

2. A device for taking out a straw for a beverage can as claimed in claim 1, wherein said rotating member has a cylindrical configuration, a portion of said rotating member is cut in a longitudinal direction and bent to define a connection piece which extends slantingly toward said can upper wall, and an upper end of said connection piece is secured to said can upper wall.

3. A device for taking out a straw for a beverage can as claimed in claim 2, wherein substantially a middle portion of said connection piece is formed with a score line, an edge of said can lid portion moving into said beverage can when said beverage can is opened is contacted to said middle portion to bend said connection piece along said score line, and said rotating member is rotated while said can lid portion is continuously moved into said beverage can after bending said connection piece.

4. A device for taking out a straw for a beverage can as claimed in claim 1, further comprising the straw having a bellows part and a straight part, said bellows part being compressively received in said inner space of said rotating member and said straight part extending from a lower end of said rotating member toward a can bottom wall.

5. A device for taking out a straw for a beverage can as claimed in claim 4, wherein the straw comprises a vinyl tube and a coil spring wound around a circumferential inner or outer surface of said vinyl tube.

6. A device for taking out a straw for a beverage can as claimed in claim 1, wherein said fixed member has a semicircular cross-section, said rotating member is fitted into said fixed member, and said upper end of said fixed member is formed with a barrier piece for blocking upward expansion of said straw.

7. A device for taking out a straw for a beverage can, comprising a plate-shaped straw take-out member having one end defining an inner space into which the straw can be inserted and formed with an engaging piece, the other end formed with a stepped portion into which said engaging piece can be engaged, and a middle portion bent such that a degree is defined between said ends, wherein said straw take-out member comprises a pair of elastic plates integrally connected with each other, said pair of elastic plates being contacted with each other and positioned into a side by side relationship when said engaging piece is engaged into said stepped portion, and said engaging piece is disengaged from said stepped portion by a can lid portion while the can lid portion is moved into said beverage can.

* * * * *